US005090880A

United States Patent [19]

Mashimo

[11] Patent Number: 5,090,880

[45] Date of Patent: Feb. 25, 1992

[54] SCROLL COMPRESSOR WITH DISCHARGE VALVES

[75] Inventor: Denji Mashimo, Gunma, Japan

[73] Assignee: Sanyo Electric Co., Ltd., Moriguchi, Japan

[21] Appl. No.: 626,892

[22] Filed: Dec. 13, 1990

[30] Foreign Application Priority Data

Dec. 28, 1989 [JP] Japan ..... 1-340808

[51] Int. Cl.[5] ..... F04B 49/02; F04C 18/04; F16K 15/14

[52] U.S. Cl. ..... 417/310; 418/55.1; 418/270; 137/512.1

[58] Field of Search ..... 418/15, 55.1, 270; 417/310, 440; 137/512.1, 855, 856

[56] References Cited

U.S. PATENT DOCUMENTS 3,042,292 7/1962 Lorenz ..... 137/512.1
4,560,330 12/1985 Murayama et al. ..... 418/55.1
4,759,696 7/1988 Ishiai ..... 418/55.1
4,838,773 6/1989 Noboru ..... 418/57
4,886,434 12/1989 Satow et al. ..... 418/55.2

FOREIGN PATENT DOCUMENTS 60-1396 1/1985 Japan ..... 418/55.1
63-58271 11/1988 Japan .

*Primary Examiner*—John J. Vrablik
*Attorney, Agent, or Firm*—Wenderoth, Lind & Ponack

[57] ABSTRACT

A scroll compresser has a fixed scroll member and an orbiting scroll member. An end plate of the fixed scroll member has a discharge opening for discharging a compressed gas, a valve plate having plural discharge ports connected to the discharge opening, and discharge valves independently mounted in the discharge ports.

2 Claims, 4 Drawing Sheets

SCROLL COMPRESSOR WITH DISCHARGE VALVES

BACKGROUND OF THE INVENTION

The present invention relates to an improvement in a scroll compressor adapted to discharge fluid, such as a fluid refrigerant compressed in a pair of compression spaces through discharge openings at the same time.

Generally, a scroll compressor has an orbiting scroll member which is substantially in an involute curve and attached to one surface of the end plate in an upstanding position, and a fixed scroll member which is formed complementary to the orbiting scroll member and is arranged in juxtaposed relation with the wraps of the two members being fitted closely together. The orbiting scroll member is moved in an orbiting motion while the rotation thereof on its own axis is inhibited by an Oldham's ring disposed between, for example, the orbiting scroll member and a main frame or a housing. The orbiting movement of the orbiting scroll member reduces the sealed space or fluid pocket defined by the two scroll members, and thus compresses a gas therein to increase its pressure. The general structure and operation of the scroll compressor are shown in, for example, U.S. Pat. Nos. 4,759,696; 4,838,773; and 4,886,434, all assigned to the present assignee.

In the conventional scroll compressor, the compressed fluid refrigerant in the compression space is exhausted at the time when the compression space is connected to the discharge opening and, accordingly, the compression ratio is determined by the number of wrap involution and the size of the discharge opening. Consequently, when refrigerants with different evaporation temperatures are used, additional suitable compressors for the different, temperature refrigerants must be employed. Thus, an attempt has been made to provide a discharge valve in the discharge opening so that the compression ratio can be changed in accordance with the difference in evaporation temperatures of the refrigerants, as shown in Japanese Patent Publication No. 63-58271, published Nov. 15, 1988.

However, in the conventional compressor shown in the above-stated Japanese Patent Publication, the change of compression ratio by means of the discharge valve to the discharge opening has the disadvantage of discontinuity in the refrigerant flow from the compression space to the discharge port and consequently the discharge valve is repeatedly opened and closed during operation thus producing noise. A discharge opening of larger diameter requires a valve of larger thickness, with the result of producing greater noise by repeatedly opening and closing the valve. Further, when the scroll compressor unit is reversely rotated, the discharge opening is closed by the discharge valve with the result that the compression space is placed under a vacuum, and the pressure difference between the compression space and sealed container of the scroll compressor causes abnormal, forcible engagement between the fixed scroll member and the orbiting scroll member, with the result of seizing.

SUMMARY OF THE INVENTION

An object of the present invention is to provide a new scroll compressor in which noise arising from the valve operation can be reduced.

Another object of the present invention is to provide new scroll compresser which can supply a fluid referigerant into the compression space even when the discharge opening is closed by the discharge valve in case of a reverse rotation of the scroll compressor unit, so that a dangerous operation under the state that the compression space is under a vacuum can be prevented.

According to the present invention, there is provided a scroll compressor comprising a fixed scroll member having an end plate and a wrap attached to a surface of the end plate and in the shape of an involute curve, an orbiting scroll member having an end plate and a wrap attached to a surface of the end plate of the orbiting scroll member in a juxtaposed relation with the fixed scroll member so that the wraps of the two scroll members are fitted closely together, the end plate of the fixed scroll member having a discharge opening, to permit a compressed gas to be discharged out of the compression space between the wraps, wherein the end plate of the fixed scroll member has a valve plate having a plurality of discharge ports connected to the discharge opening, and discharge valves adapted independently to control the discharge ports.

In a preferred embodiment, the valve plate is fixed to the end plate of the fixed scroll member to form a first space connected to the discharge opening and a second space connected to the first space. The fixed scroll member has a suction chamber between the end plate of the fixed scroll member and the orbiting scroll member, and a passage in the end plate of the fixed scroll member so that the second space is connected to the suction chamber through the passage. The end plate of the fixed scroll member has a check valve in the second space to thereby permit a one-way flow of a refrigerant through the passage.

PREFERRED EMBODIMENTS OF THE INVENTION

Figure 1:
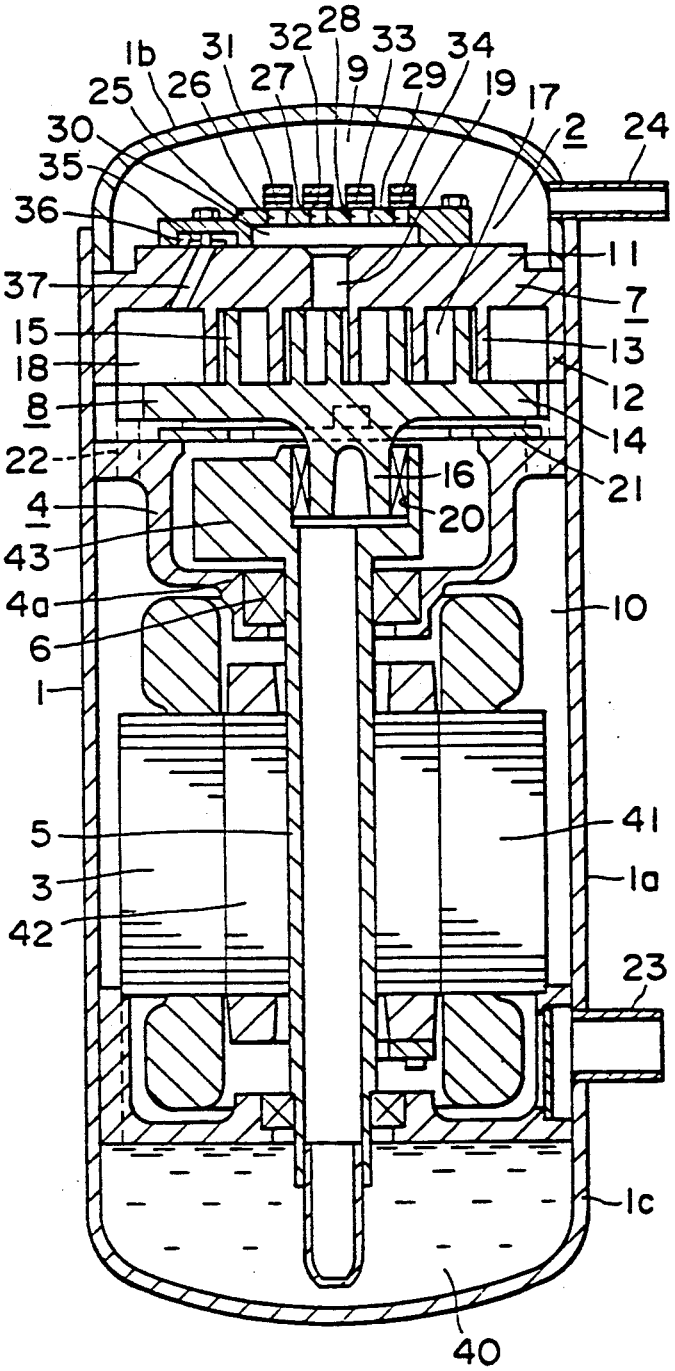
FIG. 1 is a sectional elevation of the scroll compressor according to the present invention.

Preferred embodiments of the present invention will be described with reference to the accompanying drawings. In FIG. 1, a sealed container 1 has a cylindrical case portion 1*a* in which an electric motor unit 3 is fixed, an upper cover portion 1*b* in which a scroll compressor unit 2 is fixed, and a lower portion 1*c* having an oil reservoir 40. A frame 4 fixed on the scroll compressor unit 2 is placed on the upper end surface of the cylindrical case portion 1*a*. The frame 4 is provided at the central portion, thereof with a bearing portion 4*a* formed integrally therewith and a bearing 6 therein supporting a driving shaft 5. The electric motor unit 3 has a stator 41 fixed to the inner surface of the cylindrical case portion 1*a* of the sealed container 1, and a rotor 42 mounted on the lower portion of the driving shaft 5 with an air gap between the inner surface of the stator 41 and the rotor 42. The scroll compressor unit 2 has a fixed scroll member 7 and an orbiting scroll member 8.

The fixed scroll member 7 has a disc type end plate 11 by which the interior of the sealed container 1 is divided into an upper space 9 of high pressure and a lower space 10 of low pressure, an annular wall 12 projecting from the circumferential edge of one surface of the end plate 11, and a spiral wrap 13 surrounded by this annular wall 12 and extending vertically from the end plate 11 so as to have an involute or nearly involute cross-sectional shape and a constant thickness. The end plate 11 of the fixed scroll member 7 is provided with a discharge opening 19 in the central portion thereof. The annular wall 12 and wrap 13 of the fixed scroll member 7 project downward.

The orbiting scroll member 8 has an end plate 14, a spiral wrap 15 extending vertically from one surface of the end plate 14 so as to have an involute or nearly involute cross-sectional shape, and a pin portion 16 formed on the central portion of the outer surface of the end plate 14. The wrap 15 of the orbiting scroll member 8 extends upward so as to engage the wrap 13 of the fixed scroll member 7 in an opposed relation and form a plurality of compression spaces 17 on the inner sides of wraps 13, 15. The compression spaces 17 become smaller from the outer portion to the inner portion to compress the fluid refrigerant in a suction chamber 18. A boss bore 20 is provided at the upper end portion of the driving shaft 5 so that the pin portion 16 of the orbiting scroll member 8 can be inserted therein, the center of the boss bore 20 being laterally offset from the axis of the driving shaft 5. A balance weight 43 is formed integrally with an upper portion of the driving shaft 5 in such a manner that it is positioned around the boss bore 20. An Oldham ring 21 is adapted to be turned along a circular orbit in such a manner that the orbiting scroll member 8 does not apparently revolve around its own axis with respect to the fixed scroll member 7 but turns along the circular orbit. A suction passage 22 for introducing a fluid refrigerant into the scroll compressor unit 2 is formed at the outer circumferential portion of the frame 4. A suction pipe 23 opens into the portion of the interior of the sealed container 1, at the position below the electric motor unit 3, and a discharge pipe 24 is joined to the upper cover portion **1*b* and opens out of the upper space 9 defined by the upper cover portion 1*b* and the end plate 11 of the fixed scroll member 7**.

With reference to FIGS. 2 through 5, a valve plate 25 is fixed to the end plate 11 of the fixed scroll member 7. The valve plate 25 is provided with discharge ports 26, 27, 28, 29 and a first space 30 which connects the discharge ports 26–29 with the aforementioned discharge opening 19 of the end plate 11. The valve plate 25 is provided with discharge valves 31, 32, 33, 34 for independently closing and opening the discharge ports 26–29, and a second space 36 adjacent to the first space 30. The center of each of the discharge ports 26, 27, 28 and 29 is laterally offset from the center of discharge opening 19 so that refrigerant flowing into space 30 from discharge opening 19 does not flow directly against valves 31, 32, 33 and 34. The total cross-sectional area of the discharge ports 26, 27, 28 and 29 is greater than the cross-sectional area of discharge opening 19.

Figure 2:
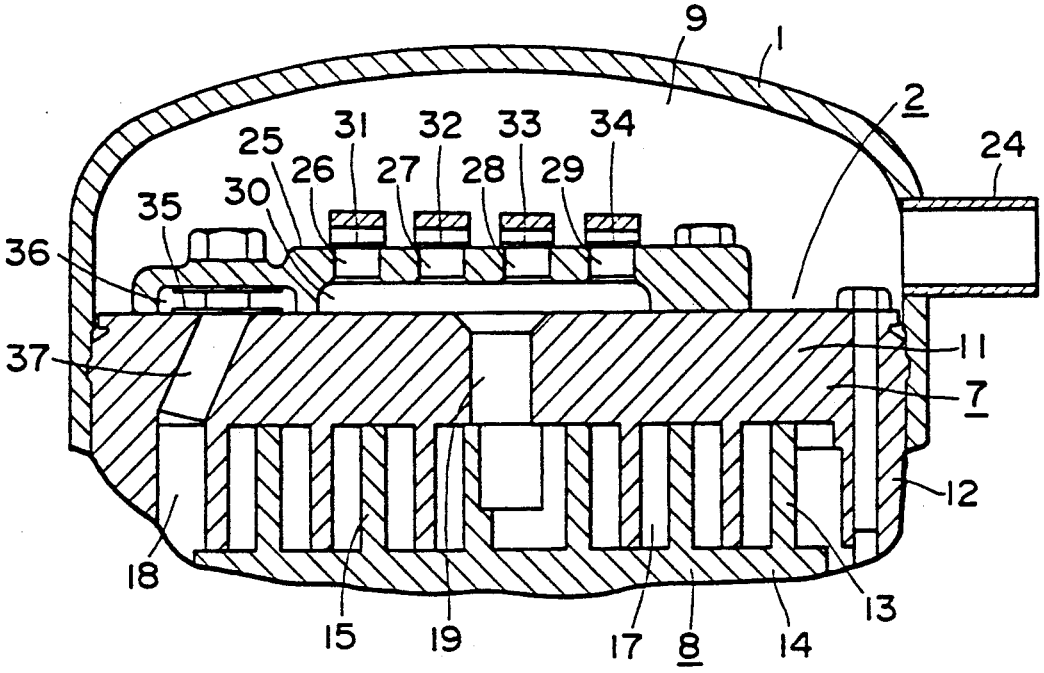
FIG. 2 is an enlarged sectional view of the fixed scroll member shown in FIG. 1, showing a valve plate fitted to the fixed scroll member.
Figure 3:
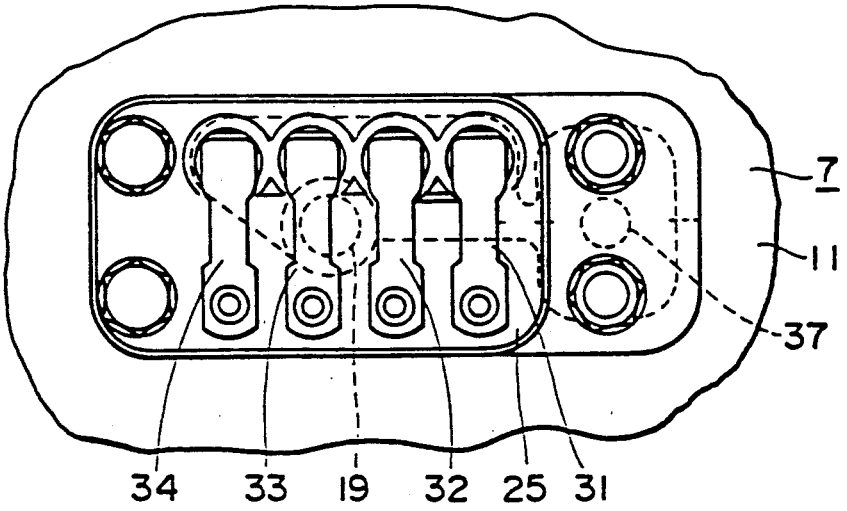
FIG. 3 is a plan view of the valve plate fitted to the fixed scroll member.
Figure 4:
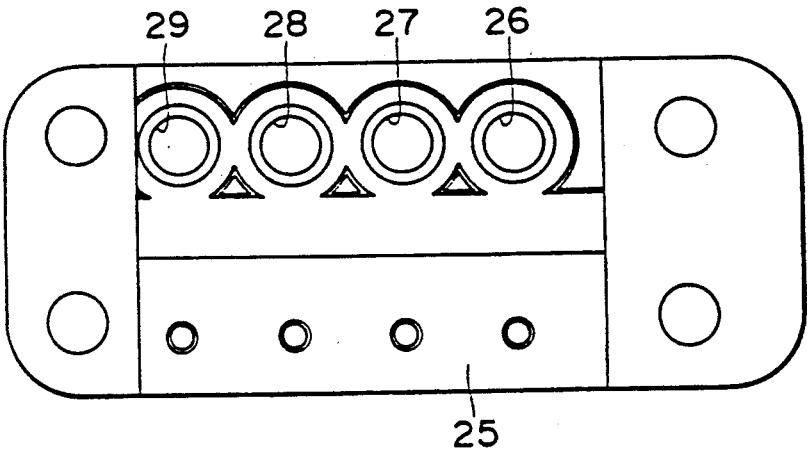
FIG. 4 is a plan view of the valve plate shown in FIGS. 2 and 3.
Figure 5:
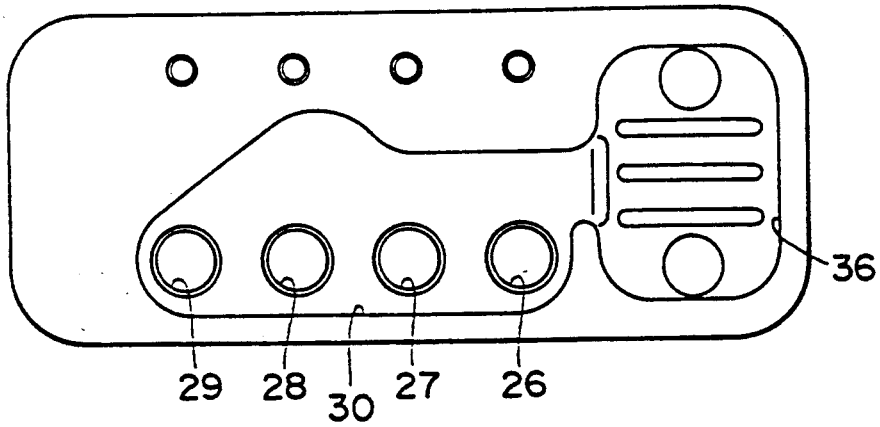
FIG. 5 is a bottom view of the valve plate.

A check valve 35 is provided on the end plate 11 of the fixed scroll member 7, in the second space 36 which is connected to the first space 30. The check valve 35 permits one-way flow of the fluid refrigerant in the suction chamber 18 through a passage 37 which is formed in the end plate 11 to connect the suction chamber 18 to the second space 36 through the check valve 35, as shown in FIG. 2.

When the electric motor unit 3 in the scroll compressor thus constucted is driven, the rotational force thereof is transmitted to the orbiting scroll member 8 via the driving shaft 5. The orbiting scroll member 8 is driven by the pin portion 16 inserted into the boss bore 20 in the driving shaft 5 eccentrically with respect to the axis of the same shaft 5, and it is thereby turned along a circular orbit so that the apparent revolution of the orbiting scroll member 8 around its own axis with respect to the fixed scroll member 7 can be prevented by the Oldham ring 21. During this time, the volume of the compression spaces 17 formed by the fixed and orbiting scroll members 7, 8, respectively, is reduced gradually from the outer side to the inner side of the compression space 17 to compress the fluid refrigerant which flows from the suction pipe 23 into the low-pressure lower space 10 of the sealed container 1 and runs through the suction passage 22 at the outer circumferential portion of the frame 4 and the suction chamber 18 via the air gap between the rotor 42 and the stator 41 in the electric motor unit 3. The compressed refrigerant runs from the discharge opening 19 of the fixed scroll member 7 to each of the discharge ports 26, 27, 28, 29 through the first space 30. By opening the discharge valves 31, 32, 33, 34 the compressed refrigerant is discharged into the upper space 9 of high pressure and then sent out through the discharge pipe 24 to the outside of the sealed container 1.

By providing the independent discharge valves 31, 32, 33, 34 in the respective discharge ports 26, 27, 28 and 29 the refrigerant compressed in the compression space 18 is discharged into the first space 30 through the discharge opening 19 and then discharged through the discharge ports 26, 27, 28, 29. The discharge valves 31–34 are opened and closed by the flow of the refrigerant with reduction of noise per valve by dividing a conventional single, discharge valve into the plural discharge valves 31–34 so that the amount of open/close movement of each valve (31–34) can be reduced. Thus, the noise arising from the valve operation for closing the discharge port can be reduced.

Further, the discharge ports 26, 27, 28, 29 are connected to the discharge opening 19 through the first space 30 and, accordingly, the diameter of the discharge ports 26–29 can be made smaller and the thickness of the discharge valves 31–34 can be reduced.

In a normal operation of the scroll compressor in which the orbiting scroll member 8 rotates normally, the check valve 35 closes the passage 37 of the end plate 11 due to the pressure difference between the high pressure in the second space 36 which is effected by the refrigerant pressure in the first space 30 and the low pressure in the passage 37, so that the refrigerant in the first space 30 does not leak into the suction passage 22.

In an abnormal operation of the scroll compressor in which the orbiting scroll member 8 is rotated reversely, the refrigerant in the compression space 17 flows from the inside to the outside to reduce the pressure in the first space 30. When the pressure in the first space 30 becomes lower than that in the suction passage 22, the check valve 35 is operated to open the passage 37 to permit the refrigerant in the suction passage 22 to immediately flow into the compressed space 17 through the first space 30 so that the compressed space does not reach a vacuum state. Thus, an abnormal, forcible contact between the fixed scroll member 7 and the orbiting scroll member 8 due to the pressure difference between the sealed container 1 and the compressed space 17 can be prevented.

Figure 6:
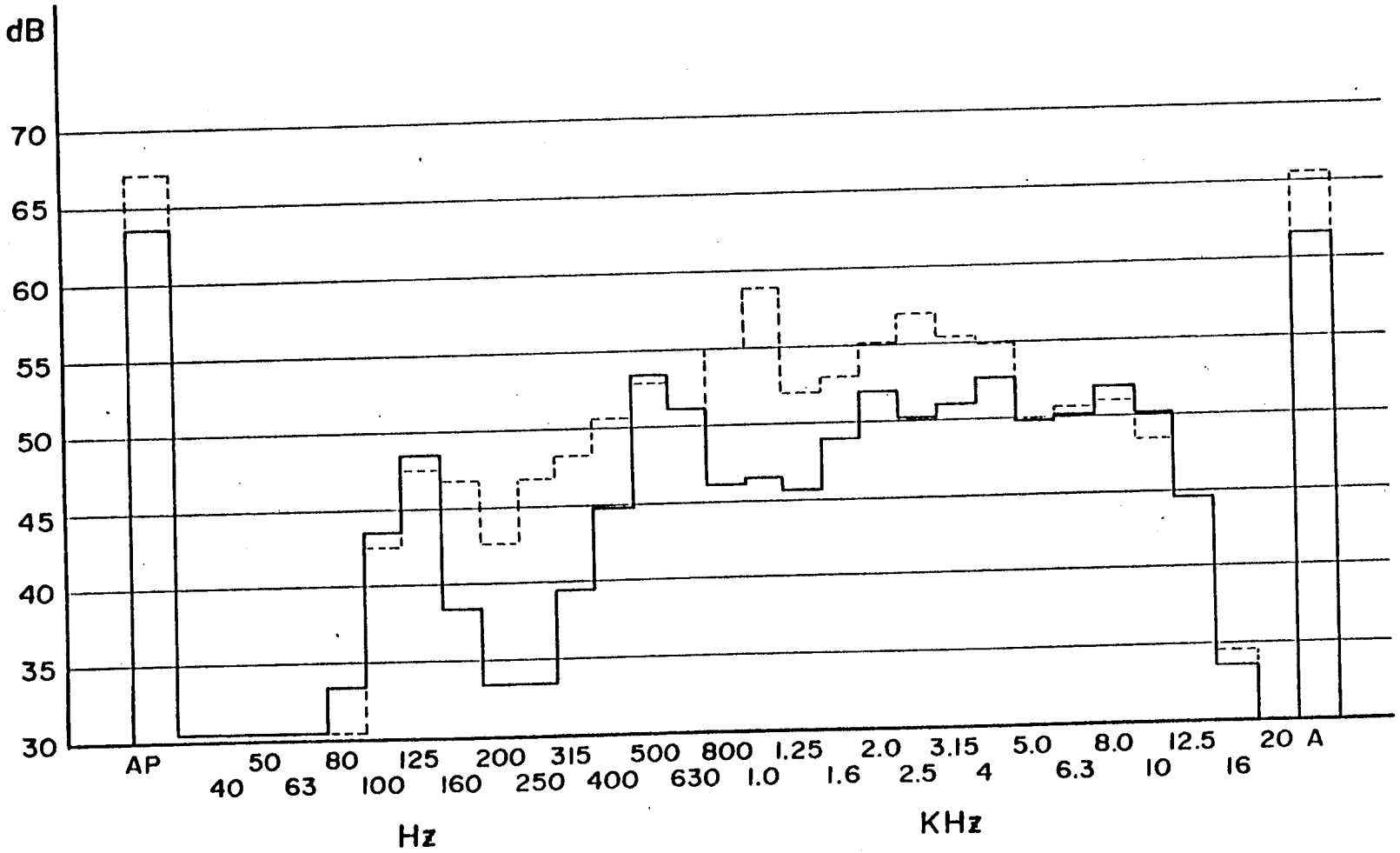
FIG. 6, is a graph showing comparatively the noise data measured for a conventional scroll compressor having a single discharge valve and in the scroll compressor according to the present invention.

FIG. 6 shows the noise data measured and obtained through a known noise measurement apparatus specified by Japan Industry Standard (JIS)-C1505, showing comparatively the noise at a ⅓ octave band frequency, with respect to the conventional scroll compressor of a single discharge port and the new scroll compressor according to the present invention. The noise measurement was made at the position which crosses at right angle with respect to the movement, or the moving direction, of the Oldham ring 21. In FIG. 6, the solid line represents the noise in the scroll compressor in the present invention at the sound pressure level (SPL) and the dotted line similarly represents the noise in the conventional scroll compressor having only one discharge port. As illustrated in FIG. 6, the multi-valve structure of the scroll compressor according to the present invention can reduce the noise of A-scale by reducing the sound in the frequency range of 1000–2000 Hz.

According to the present invention, the valve plate having a plurality of discharge ports is fixed to the fixed scroll member and discharge valves are independently fitted to the discharge ports and, consequently, the open/close movement can be minimized and the thickness of the discharge valves can be reduced, with the result that noise arising from the valve operation can be reduced without sacrifice of mechanical strength of the valve device.

In addition, the check valve in the valve plate, which can have a simple structure, can prevent effectively any wearing of the scroll members which is produced when the scroll members are reversely rotated to produce vacuum in the compression space.

What is claimed is:

1. A scroll compressor comprising:

a fixed scroll member having an end plate and a wrap attached to surface of said end plate in the shape of an involute curve;

an orbiting scroll member having an end plate and a wrap attached to a surface of said end plate of the orbiting scroll member in a juxtaposed relation with said fixed scroll member so that the wraps of the two scroll members are fitted closely together to form a compression space;

said end plate of said fixed scroll member having:

a discharge opening to permit a compressed gas to be discharged out of said compression space;

a valve plate having a plurality of discharge ports connected to said discharge opening, and independent discharge valves in each of said discharge ports, wherein a center of each of said discharge ports is laterally offset from a center of said discharge opening of said fixed scroll member to thereby prevent a refrigerant from flowing directly from said discharge opening against said discharge valves, and the total cross-sectional area of said discharge ports is larger than the area of said discharge opening.

2. The scroll compressor according to claim 1, wherein said valve plate is fixed to said end plate of said fixed scroll member to form a first space connected to said discharge opening and a second space connected to said first space, said fixed scroll member having a suction chamber between said end plate of the fixed scroll member and said orbiting scroll member and a passage in said end plate of said fixed scroll member connecting said second space to said suction chamber through said passage, and wherein said end plate of the fixed scroll member has a check valve in said second space to thereby permit a one-way flow of a refrigerant through said passage.

* * * * *